United States Patent [19]

Schuetz

[11] Patent Number: 4,694,976

[45] Date of Patent: Sep. 22, 1987

[54] DISCHARGE APPARATUS FOR FLOWABLE MEDIA

[75] Inventor: Hans-Josef Schuetz, Donaueschingen, Fed. Rep. of Germany

[73] Assignee: Ing. Erich Pfeiffer GmbH & Co. KG, Fed. Rep. of Germany

[21] Appl. No.: 815,569

[22] Filed: Jan. 2, 1986

[30] Foreign Application Priority Data

Feb. 1, 1985 [DE] Fed. Rep. of Germany ..... 3503354

[51] Int. Cl.[4] ..... B65D 37/00

[52] U.S. Cl. ..... 222/189; 222/321; 222/385; 222/481; 210/416.1; 210/436; 55/467

[58] Field of Search ..... 222/189, 321, 385, 481; 210/416.1, 436; 55/279, 467, 528; 239/333, 575, DIG. 23; 604/126, 405; 215/308

[56] References Cited

U.S. PATENT DOCUMENTS

| | | | |
|---|---|---|---|
| 2,301,989 | 11/1942 | Wallenmeyer et al. | 128/214 |
| 2,754,821 | 7/1956 | Burbig et al. | 128/249 |
| 3,134,512 | 5/1964 | Lehman | 222/189 |
| 3,149,758 | 9/1964 | Bush et al. | 222/189 |
| 3,194,447 | 7/1965 | Brown | 222/321 |
| 3,746,260 | 7/1973 | Boris | 222/321 |
| 3,760,987 | 9/1973 | Meterhoefer | 222/189 |
| 3,774,849 | 11/1973 | Boris | 222/385 |
| 3,951,293 | 4/1976 | Schulz | 55/528 |
| 3,986,851 | 10/1976 | Grodek | 55/528 |
| 4,025,679 | 5/1977 | Denny | 55/528 |
| 4,253,501 | 3/1981 | Ogle | 604/405 |
| 4,262,671 | 4/1981 | Kersten | 128/272.3 |
| 4,344,744 | 8/1982 | Schuster et al. | 222/321 |
| 4,533,068 | 8/1985 | Meierhoefer | 222/189 |

FOREIGN PATENT DOCUMENTS

| | | |
|---|---|---|
| 1299386 | 7/1969 | Fed. Rep. of Germany . |
| 2934334 | 7/1980 | Fed. Rep. of Germany . |
| 3230310 | 5/1983 | Fed. Rep. of Germany . |
| 3408711 | 9/1984 | Fed. Rep. of Germany . |

*Primary Examiner*—H. Grant Skaggs
*Attorney, Agent, or Firm*—Steele, Gould & Fried

[57] ABSTRACT

The discharge pump of a discharge apparatus for flowable media is provided with a ventilating channel for the ventilation of the active substance dispenser and the resulting ventilation connection along the channel passes through a bacteria filter. The filter is arranged on a casing of the pump disposed within the reservoir, the filter facing an opening on the casing for the ventilating passage, at a slight spacing from the pump casing. Thus, bacteria which otherwise could penetrate with the ventilating air passing along the ventilating channel from the discharge pump into the reservoir, is held back within the discharge pump.

21 Claims, 3 Drawing Figures

1
9
4
11
26
23
22
8
12
34
6
14
28
13
31
21
7
10
15
5
11
27
2
20
16
3
17
18
19

3
34
33
25
28
31
32

9
23
4
26
8
12
30
24
33
25
14
29
28
13
III
III
31
7
27
34
35

DISCHARGE APPARATUS FOR FLOWABLE MEDIA

BACKGROUND OF THE INVENTION

The present invention relates to a discharge apparatus for flowable media, particularly for pharmaceutical and/or cosmetic products, with a discharge channel for the active substance and with a ventilating channel forming a ventilation connection for volume compensation of the discharged active substance.

Numerous pharmaceutical and cosmetic products have characteristics making them suitable, in the manner of a nutrient medium, for the propagation of bacteria and the like. In order to prevent the spoiling of such products by the penetration of bacteria via the ventilation connection of the active substance dispenser, germicidal stabilizers must be added to such products. However, the application of such stabilizers to patients can lead to incalculable side-effects, which are extremely undesirable.

SUMMARY OF THE INVENTION

The problem of the invention is to so construct a discharge apparatus of the aforementioned type that a penetration of bacteria or germs is largely precluded, so that also in the case of products which could form a nutrient medium for bacteria, there is no need to add germicidal stabilizers or alternativley the quantity of such stabilizers can be significantly reduced.

In the case of a discharge apparatus of the aforementioned type, according to the invention this problem is solved in that the ventilation connection passes through a bacteria filter. As a result of this surprisingly simple measure, in the generally very small-volume active substance dispensers, it is possible to arrange a device wherein no germs or bacteria can pass into the active substance in the dispenser reservoir with the air drawn into the dispenser reservoir via the ventilation connection for volume compensation or balance purposes. All that is necessary is that the pore size of the bacteria filter be smaller than the size of the bacteria.

In order that the dimensions of the apparatus do not have to be increased or only have to be insignificantly increased for the incorporation of the bacteria filter, the latter is appropriately flat and in particular membrane-like, preferably comprising a fibrous filter of polytetrafluoroethylene or the like.

The compact, space-saving housing of the bacteria filter is still further improved if the filter is placed against a wall surface traversed by the ventilation channel at a passage opening preferably located with a limited spacing parallel to or with constant spacing with respect to the said wall surface.

A particularly advantageous further development of the invention is obtained if the ventilation channel is sealed with at least one ring seal in the vicinity of the bacteria filter, the ring seal preferably being constructed in one-part manner integrally with the filter. Therefore even when the latter is clogged to a significant extent, it is ensured that not even part of the ventilation air sucked back into the active substance reservoir can bypass the bacteria filter. In a very simple embodiment, the in particular bead-like ring seal is formed by pressing, adhesion, welding, etc and is preferably directly connected to the associated dispenser wall surface.

According to a further development of the invention the bacteria filter is much larger and in particular very much larger than the remaining cross-section of the ventilation connection. Preferably the bacteria filter and its ring seal and the associated wall surface traversed by the ventilation channel bounds a filter inlet chamber, into which issues the much smaller passage opening and in particular centrally faces the bacteria filter. As a result, with a comparatively compact construction, it is possible to obtain a very high absorption capacity of the filter, so that even with relatively high filter loading, an adequate filter permeability for maintaining the ventilation of the dispenser is ensured.

For the simple, space-saving and reliably sealed fixing of the bacteria filter, the latter is surrounded on its side remote from the wall surface by a window-like holding frame, which is preferably directly fixed to the wall surface, e.g. by welding, bonding or the like and with which the filter engages preferably with the same ring seal projecting on either side over its thickness as on the wall surface, so that a good sealing pressing effect can be obtained.

According to another feature of the invention, the bacteria filter is located within said active substance reservoir, so that it is effectively protected against mechanical stressing or damage and only comes into contact with that air which flows through the ventilation connection into the reservoir for volume compensation purposes. A particularly simple fitting is obtained if the bacteria filter is arranged on the active substance discharge pump, such as the casing of a manually operated piston pump. The bacteria filter is appropriately positioned at a slight spacing on a wall surface roughly curved round the central axis of the discharge channel and/or directly follows onto a discharge pump mounting flange projecting over said wall surface. If the pump casing is in two parts, e.g. comprising the cylinder casing guiding the pump piston and a reservoir cover closing same at the outer end, then the bacteria filter is appropriately only fixed to one of these two components, preferably to the cylinder casing.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
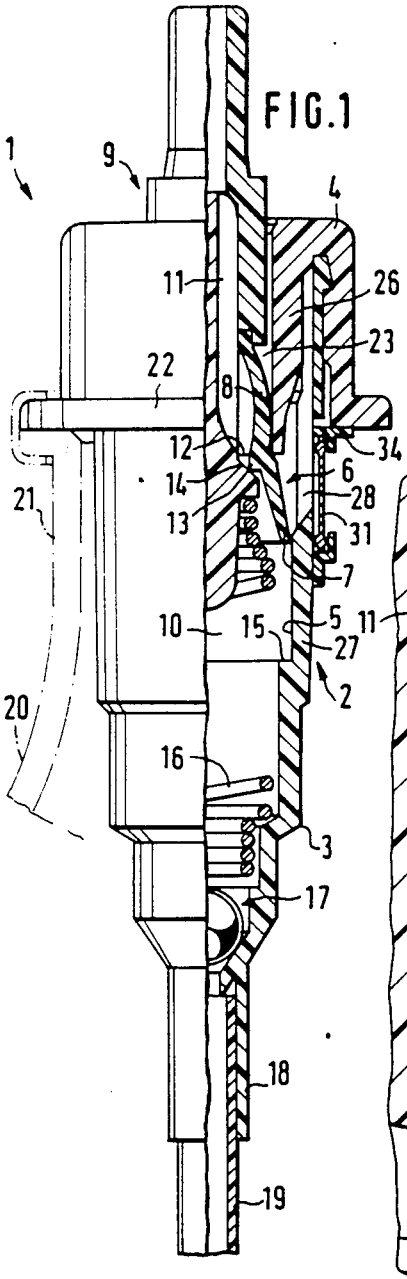
FIG. 1. The active substance discharge pump of a dispenser according to the invention, partly in axial section.
Figure 3:
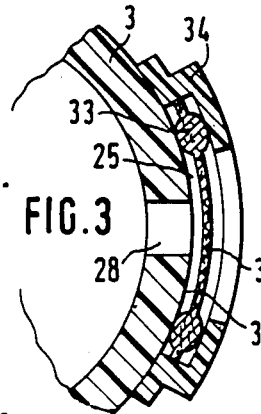
FIG. 3. A section along line III—III of FIG. 2.
Figure 2:
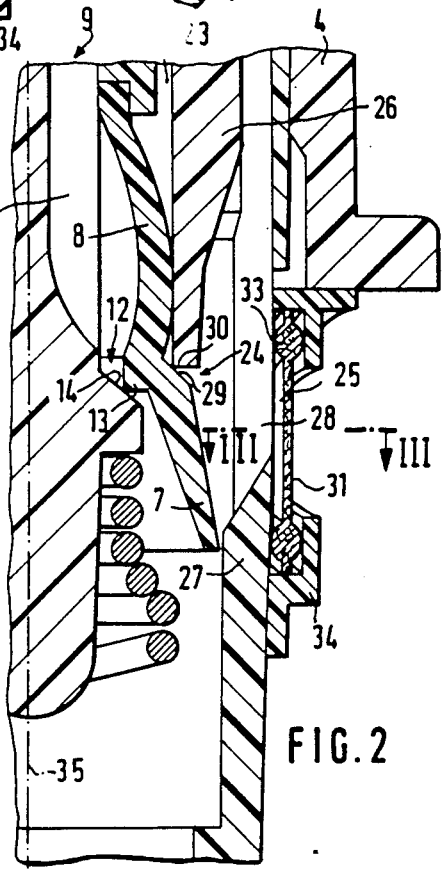
FIG. 2. A larger scale detail of FIG. 1.

As shown by FIGS. 1 to 3, the discharge pump 1 according to the invention has an active substance dispenser which is not shown in detail, a substantially axial symmetrical pump casing 2, which essentially comprises a cylinder casing 3 becoming narrower in stepped manner towards the inner end and a cover or cap 4, which is fixed to the outer, most remote end of the casing 3 by clip-like snapping in in such a way that the circumference surface of the cylinder casing 3 overlaps in the vicinity of the associated end, as well as on the inner and outer circumference. In a substantially cylindrical piston track 5 provided following on to cap 4 in casing 3 is slidably guided a pump piston 6 with a piston sleeve 7 made from elastic material and which conically tapers in the manner of a truncated cone sleeve towards the outer end of casing 2 and is guided with its inner end in the manner of a ring sealing lip on the track 5. To the rear end of the piston sleeve 7 is connected an elastic compression sleeve 8 constructed in one part with piston sleeve 7. The outer end of compression sleeve 8 is fixed by annular attachment to a piston rod 9 which, for operating by hand, projects from cap 4, has an active substance discharge channel 11 extending from the pump chamber 10 receiving piston 6 to its outer end and in which said channel 11 passes through the interior of the piston sleeve 7 and the compression sleeve 8. In the transition region between piston sleeve 7 and compression sleeve 8 is provided a discharge valve 12, whose annular, movable valve closing part is formed by an annular valve lip projecting over the inner face of said component and forms the piston sleeve 7 and/or the compression sleeve 8. The valve seat 14 for said valve closing part 13 is conically widened in obtuse-angled manner towards the inner end of discharge pump 1 and is formed by the piston rod 9. The valve closing part 13 is pressed by axial pretension of compression sleeve 8 against valve seat 14. Discharge valve 12 can be constructed as an excess pressure valve or, as in the represented embodiment, as a mechanically opening valve, which is opened at the end of the pump lift by piston sleeve 7 running up onto a stop shoulder 15 of pump casing 2. Pump piston 6 is loaded towards the initial or starting position by a pretensioned restoring spring 16 arranged in cylinder casing 3, which is support on the one hand on the inner end of piston rod 9 and on the other hand in the vicinity of an inlet valve 17, constucted as a restoring valve, for pump chamber 10 with respect to the pump casing 2.

Inlet valve 17 constructed as a simple ball valve is provided following on to a connecting piece 18, which forms the narrowest inner end of cylinder casing 3 and is used for receiving one end of a lift tube 19, whose other end is appropriately positioned in the bottom region of the reservoir facing the discharge pump 1. Discharge pump 1 is appropriately arranged in or on the reservoir indicated in dot-dash line manner at 20, that pump casing 2, following on to cap 4 engages in the neck 21 of reservoir 20 and an annular mounting flange 22 provided on cap 4 and projecting over its circumference is tensioned in sealed manner against the outer end face of neck 21.

A ventilating channel 23 passes through discharge pump 1 as a ventilation connection between the interior of reservoir 20 and the outer atmosphere. Channel 23 is formed between the outer atmosphere and a ventilating valve 24 located within pump casing 2 in a filter inlet chamber 25 by an annular clearence, which is defined radially inwards by the outer portion of piston rod 9 and the compression sleeve 8 connected thereto and radially outwards by an inner sleeve 26 forming the portion of cap 4 engaging in cylinder casing 3. In the vicinity of filter inlet chamber 25, wall 27 of casing 3 is traversed by an axial slot-like opening 28, which forms the ventilation connection to the inlet chamber 25 and the interior of reservoir 20.

The movable valve closing part 29 of ventilating valve 24 is formed by a portion of piston sleeve 7 or compression sleeve 8 widened on the outer circumference in frustum-like manner towards pump chamber 10, said portion essentially being located in the same axial region as the valve closing part 13. The inner end of inner sleeve 26 constitutes the valve seat 30 for valve closing part 29 and on its radially inner terminal edge part 29 engages under pretension in the initial position of pump piston 6 in such a way that the discharge valve 12 is simultaneously under the closing pressure. Thus, in the initial position, both the discharge channel 11 and the ventilation channel 23 are forcibly closed in sealed manner. At the beginning of the pump lift, the valve closing part 29 is raised from valve seat 30, so that the ventilation valve 24 and consequently ventilating channel 23 is opened into the interior of reservoir 20.

In the ventilation connection between the outer atmosphere and the interior of reservoir 20 having ventilation channel 23 is provided a bacterior filter 31, which in the immediate vicinity of the outer circumference of cylinder casing 3 is applied to its associated wall surface 32. The flat and e.g. circular disc-like bacteria filter 31 is arranged in the vicinity of opening 28 and symmetrically to the axial plane of discharge pump 1 passing through the same in such a way that the ventilating air flowing from inlet chamber 25 into reservoir 20 passes exclusively and completely through bacteria filter 31 into reservoir 20. Filter 31 is constructed in one part with a closed, all-round ring seal 33 adjacent to its outer circumference and which in the manner of tori project on either side roughly equally far over the surfaces of the bacteria filter 31, so that on each surface a projecting ring seal is formed and in elevation view of filter 31, the two ring seals are substantially congruent to one another. With ring seal 33, bacteria filter 31 is applied under pressure on the one hand against wall surface 32 and on the other with the side of said ring seal 33 remote from said wall surface 32 is applied to a window-like holding frame 34, which is fixed e.g. by pressing, bonding, welding, etc to cylinder casing 3, particularly exclusively to the wall surface 32. In the represented embodiment, the holding frame 34 is designed in such a way that it is fixed in the vicinity of the inner end face of mounting flange 22 also to cap 4, but it is appropriate in most cases to fix frame 34 only to one of the two components forming the pump casing 2 and optionally to allow it to engage in cap 4 in the vicinity of mounting flange 22. The central opening of holding frame 34 forms the inlet into reservoir 20 of the ventilating air passing out of the bacteria filter 31. This inlet is only slightly smaller than the filter zone within ring seal 33. Holding frame 34 is appropriately at least partly angular in cross-section, so that one angle leg engages over ring seal 33 and the other angle leg is used for fixing to pump casing 2. Holding frame 34 can also e.g. be formed by at least one ring or a sleeve, which is mounted, e.g. by pressing and/or is welded to the pump casing 2, so that the frame surrounds the outer circumference of casing 2 or is located in the central axis 35 of discharge pump 1.

What is claimed is:

1. A discharge apparatus for fluid media, comprising:

a manually-operated discharge pump, for mounting on a container defining a fluid reservoir in an assembled condition of the pump and container, said discharge pump having a pump casing projecting at least by an immersing part into the fluid reservoir in the assembled condition, the pump casing being bounded on curved outer surfaces by a casing wall, the outer surfaces being substantially curved around a pump axis, a ventilating duct for the fluid reservoir being provided in said discharge pump and issuing at a venting opening in the casing wall of said immersing part; and, a bacteria filter provided on the pump casing, traversing a part of said ventilating duct, said bacteria filter having a ring-like sealing part surrounding an effective filter section, an air inlet side and an air outlet side and being mounted with the sealing part against one of the curved outer surfaces of the casing wall of said immersing part, said ring-like sealing part projecting from at least the inlet side of said bacteria filter and sealing the effective filter section at a substantially constant spacing from said one of the outer surfaces of the casing wall with respect to this outer surface, the bacteria filter thereby being curved around said pump axis and bounding a part of the fluid reservoir with the discharge pump and reservoir in the assembled condition, said effective filter section being arranged free of contact on both the inlet and outlet sides, said bacteria filter and an adjacent outer surface of said casing wall defining a filter inlet chamber, said venting opening traversing said outer surface opposite to the bacteria filter and being substantially smaller than a boundary of said filter inlet chamber defined by the ring-like sealing part of the bacteria filter.

2. A discharge apparatus according to claim 1, wherein the pump casing has a mounting flange provided adjacent said immersing part for mounting the discharge pump against a neck of the container defining the reservoir, said bacteria filter being arranged directly adjacent said mounting flange.

3. A discharge apparatus according to claim 1, wherein the ventilating duct has a certain maximum cross-section apart from said bacteria filter and the bacteria filter has an effective filter section substantially larger than said certain cross section.

4. A discharge apparatus according to claim 1, wherein said ring-like sealing part is substantially constructed integrally with the bacteria filter.

5. A discharge apparatus according to claim 4, wherein the ring-like sealing part has a bead shape.

6. A discharge apparatus according to claim 1, wherein the ring-like sealing part is formed substantially in one part with the bacteria filter, material forming the bacteria filter being compressed to define the ring-like sealing part and the effective filter section.

7. A discharge apparatus according to claim 1, wherein the ring-like sealing part is formed substantially in one part with the bacteria filter, material forming the bacteria filter being bonded to define the ring-like sealing part and the effective filter section.

8. A discharge apparatus according to claim 1, wherein the ring-like sealing part is formed substantially in one part with the bacteria filter, material forming the bacteria filter being welded to define the ring-like sealing part and the effective filter section.

9. A discharge apparatus according to claim 1, wherein on a side remote from the outer surface of the casing wall, the bacteria filter is engaged by a window-like holding frame.

10. A discharge apparatus according to claim 9, wherein the holding frame is directly fixed to the outer surface of the casing wall.

11. A discharge apparatus according to claim 9, wherein the holding frame is welded to the outer surface of the casing wall.

12. A discharge apparatus according to claim 9, wherein the holding frame is bonded to the outer surface of the casing wall.

13. A discharge apparatus according to claim 9, wherein only one ring-like sealing part common to the inlet and outlet sides of said bacteria filter projects above the inlet and outlet sides, respectively, said ring-like seal part engaging the holding frame on the outlet side of the bacteria filter.

14. A discharge apparatus according to claim 1, wherein the immersing part of the pump casing includes a cylinder casing of the discharge pump, the discharge pump being a piston pump.

15. A discharge apparatus according to claim 1, wherein the bacteria filter is constructed as a flat membrane.

16. A discharge apparatus according to claim 1, wherein the bacteria filter comprises a fibrous polytetrafluoroethylene filter medium.

17. A discharge apparatus according to claim 1, further comprising a ventilating valve arranged in the ventilating duct.

18. A discharge apparatus according to claim 17, further comprising a discharge valve in a discharge channel of the discharge pump.

19. A discharge apparatus according to claim 17, wherein the ventilating valve is forcible closed when the discharge pump is in an initial position.

20. A discharge apparatus according to claim 1, further comprising a discharge valve in a discharge channel of the discharge pump.

21. A discharge apparatus according to claim 20, wherein the discharge valve is forcibly closed when the discharge pump is in an initial position.

* * * * *